US008800176B2

(12) United States Patent
Stewart et al.

(10) Patent No.: US 8,800,176 B2
(45) Date of Patent: Aug. 12, 2014

(54) UNDERWATER EXCAVATION APPARATUS

(75) Inventors: Kenneth Roderick Stewart, Aberdeenshire (GB); Donald Stewart, Munlochy (GB)

(73) Assignee: Rotech Limited (GB)

( * ) Notice: Subject to any disclaimer, the term of this patent is extended or adjusted under 35 U.S.C. 154(b) by 193 days.

(21) Appl. No.: 12/915,329

(22) Filed: Oct. 29, 2010

(65) Prior Publication Data

US 2011/0099859 A1 May 5, 2011

(30) Foreign Application Priority Data

Oct. 30, 2009 (GB) ..... 0919066.1

(51) Int. Cl.

| | |
|---|---|
| ***E02F 3/88*** | (2006.01) |
| ***E02F 3/00*** | (2006.01) |
| ***E02F 5/28*** | (2006.01) |
| ***E02F 3/92*** | (2006.01) |

(52) U.S. Cl.

CPC ..... *E02F 5/287* (2013.01); *E02F 3/9206* (2013.01)

USPC ..... 37/344; 37/323

(58) Field of Classification Search

USPC ..... 37/307, 317–323, 343, 344, 195; 405/163; 175/66, 67, 424; 406/88, 96, 406/157–162

See application file for complete search history.

(56) References Cited

U.S. PATENT DOCUMENTS

| | | | | |
|---|---|---|---|---|
| 2,711,598 | A * | 6/1955 | Craggs, Jr. | 37/323 |
| 2,956,354 | A | 10/1960 | Varner | |
| 4,112,695 | A * | 9/1978 | Chang et al. | 405/163 |
| 6,125,560 | A * | 10/2000 | Beaumont | 37/344 |
| 6,843,003 | B2 * | 1/2005 | Araoka | 37/317 |

FOREIGN PATENT DOCUMENTS

| | | | |
|---|---|---|---|
| DE | 3833831 | A1 | 4/1990 |
| EP | 1108819 | A1 | 6/2001 |
| GB | 2444259 | A | 6/2008 |
| GB | 2459700 | A | 11/2009 |
| JP | 2000-87389 | A | 3/2000 |
| WO | WO 99/50508 | A1 | 10/1999 |

OTHER PUBLICATIONS

Search Report corresponding to International Application No. GB0919066.1 dated Feb. 15, 2010.

Partial European Search Report corresponding to European Application No. 10251850.3 dated Jan. 2, 2014.

Examination Report corresponding to British Application No. GB0919066.1 dated Apr. 11, 2014.

* cited by examiner

*Primary Examiner* — Robert Pezzuto

(74) *Attorney, Agent, or Firm* — Myers Bigel Sibley & Sajovec, P.A.

(57) ABSTRACT

The present invention relates to an underwater excavation apparatus and a method of excavation with the same. The apparatus of the invention performs the excavation by both mass flow and jet flow. Mass flow excavation takes place at a pressure that is lower than the jet flow excavation performed by the apparatus, and the volume flow rate of the mass flow excavation is greater than the volume flow rate of the jet flow excavation performed by the apparatus. The outlet for jet flow excavation is provided within the outlet for mass flow excavation of the apparatus.

83 Claims, 5 Drawing Sheets

UNDERWATER EXCAVATION APPARATUS

RELATED APPLICATIONS

This application claims priority from British Patent Application No. GB 0919066.1; filed Oct. 30, 2009, the disclosure of which is incorporated by reference herein in its entirety.

FIELD OF INVENTION

This invention relates to an improved excavation or mining apparatus, and in particular to an improved underwater excavation apparatus. This invention also relates to a method of underwater or sub-sea excavation using such an excavation apparatus.

BACKGROUND TO INVENTION

Underwater excavation apparatus are known. The terms "mass flow" and "jet flow" are known, and understood in the art. Mass flow relates to flow at relatively low pressure and high volume, whereas jet flow relates to flow at relatively high pressure and low volume.

GB 2 297 777 A (Holandsche Beton Groep NV) discloses an underwater excavation apparatus comprising a hollow body having an inlet and an outlet, at least one pair of impellers coaxially displaced one from the other and rotatably mounted in the hollow body and means for driving the impellers of the/each pair in contrary rotating directions.

WO 98/027286 A (Ledingham Chalmers Trustee Company Limited) discloses an underwater excavation apparatus comprising a hollow body having at least two inlets and at least one outlet, at least one pair of impellers rotatably mounted in the hollow body, and means for driving the impellers, wherein the at least two inlets are substantially symmetrically disposed around an axis extending from the at least one outlet. Therein, preferably, the driving means cause the impellers to be driven in contra-rotating directions, and one of the impellers is provided within one of the inlets and another of the impellers is provided within another of the inlets.

GB 2 301 128 B (Ledingham Chalmers Trustee Company Limited) discloses an underwater excavation apparatus comprising an agitator device having mechanical disturbance means and fluid flow disturbance means which comprise a hollow drill bit having at least one hole provided in a side wall thereof, the drill bit providing a plurality of paddles disposed longitudinally and radially extending upon the drill bit and substantially equidistantly spaced one from another.

WO 2008/065360 A1 (Rotech Holding Limited) discloses an underwater excavation apparatus comprising a hollow body having at least one pair of inlets and at least one outlet, at least one pair of impellers rotatably mounted in the hollow body, means for driving the impellers, and at least one means for moving the underwater excavation apparatus, the at least one moving means being provided on or adjacent to the underwater excavation apparatus.

All of the above prior art underwater excavation apparatus are "mass flow" apparatus.

It is an object of at least one embodiment of at least one aspect of the present invention to seek to obviate or at least mitigate one or more problems in the prior art.

It is an object of at least one embodiment of at least one aspect of the present invention to seek to provide an improved underwater excavation apparatus.

It is an object of the least one embodiment of at least one aspect of the present invention to seek to provide an underwater excavation apparatus which is particularly useful in relatively shallow waters, e.g. 1 to 10 m, 1 to 2 m, or a few meters.

SUMMARY OF INVENTION

According to the present invention there is provided a general solution of an excavation apparatus or mining apparatus, particularly an underwater excavation apparatus or mining apparatus, comprising a jet flow means and mass flow means.

According to a first aspect of the present invention there is provided an excavation apparatus, particularly an underwater excavation apparatus, comprising at least one mass flow excavation means and at least one jet or jet flow excavation means.

The excavation apparatus may be adapted for use submerged in a body of fluid/water, e.g. a sea, ocean, estuary, river, lake, loch or the like.

The mass flow excavation means is advantageous or beneficial for moving material(s) with relatively low pressure(s) (Kilopascals, KPa), e.g. sand, and/or pre-loosened or disrupted materials. The jet flow excavation means is advantageous in cutting through or disrupting material(s), particularly material(s) with relatively high pressure(s) (KPa), e.g. clay. In use, the jet flow excavation means may cut through or disrupt material(s) and the mass flow excavation means may move or transport material(s). Therefore, the combination of jet flow excavation means and mass flow excavation means has been found to be beneficial.

The at least one mass flow excavation means may comprise a housing or hollow tubular member and optionally at least one impeller or rotor provided within the housing or hollow tubular member, which impeller may comprise a plurality of blades.

The at least one jet flow excavation means may face substantially downwardly, in use, and/or may comprise at least one nozzle or further hollow tubular member.

In use, the at least one mass flow excavation means may operate at or cause a/the mass flow at a pressure less than a pressure of a jet flow operated at or caused by the at least one respective jet flow excavation means.

In use, the at least one mass flow excavation means may operate at or cause a/the mass flow at a volume (flow) rate greater than a jet flow volume rate operated at or caused by the at least one respective jet flow excavation means.

In use, the at least one mass flow excavation means may operate at or cause a/the mass flow at a pressure or around 10 to 50 KPa (KiloPascals).

In use, the at least one mass flow excavation means may operate at or cause a/the mass flow at a volume rate of around 0.5 to 8.0 $m^3/s$, e.g. around 0.5 to 2.5 $m^3/s$.

In use, the at least one jet flow excavation means may operate at or cause a/the jet flow at a pressure of around 100 to 500 KPa (KiloPascals).

In use, the at least one jet flow excavation means may operate at or cause a/the jet flow at a volume rate of around 0.1 to 0.25 $m^3/s$.

Most preferably an outlet (e.g. an area of said outlet) of the at least one jet flow excavation means may be provided within an outlet (e.g. an area of said outlet) of the at least one mass flow excavation means.

A breadth or diameter of the outlet of the at least one jet flow excavation means (e.g. an outlet of a/the nozzle) may typically be around 12 to 15 cm.

A breadth or diameter of the outlet of the at least one mass flow excavation means may typically be around 75 to 125 cm, e.g. 1 m.

Most preferably a/the outlet of the at least one jet flow excavation means or nozzle may be substantially longitudinally aligned with or coincident with a/the outlet of the at least one mass flow excavation means.

In use, at least one mass flow from at least one of the at least one mass flow excavation means may be substantially longitudinally aligned with or substantially parallel to at least one jet flow from at least one of the at least one jet flow excavation means.

Preferably a/the outlet of the at least one mass flow excavation means may comprise a closed shape, e.g. advantageously circular, or alternatively elliptical, oval, oblong square, rectangular or the like.

Preferably a/the outlet of the at least one jet flow excavation means may comprise a closed shape, e.g. advantageously circular, or alternatively, elliptical, oblong, oval, square, rectangular or the like.

An inlet of the at least one jet flow excavation means may taper or flare outwardly.

An inlet of the at least one jet flow excavation means may be disposed to face in substantially a same direction as a/the outlet of the mass flow excavation means and/or a/the outlet of the jet flow excavation means.

A/the outlet of the at least one mass flow excavation means may be disposed so as to face at least partially or preferably substantially downwardly, in use.

A/the outlet of the at least one jet flow excavation means may be disposed so as to face substantially downwardly, in use.

A/the inlet of the at least one jet flow excavation means may be disposed in a different direction to a/the respective inlet(s) of the mass flow excavation means.

A/the inlet of the at least one jet flow excavation means may be disposed so as to face substantially downwardly, in use A/the inlet of the at least one jet flow excavation means may be provided with a filter means.

A/the outlet of the at least one mass flow excavation means may be inverted frusto-conical in shape.

A/the nozzle of the at least one jet flow excavation means may be substantially cylindrical/elongate in shape.

An/the outlet of a jet flow means may be surrounded by or provided or contained within a/the outlet of the mass flow means, e.g. in transverse cross-section.

An/the outlet of the at least one mass flow excavation means may be substantially concentric with or centralised with a/the outlet of or a/the nozzle of the at least one jet flow excavation means. An inlet means to the nozzle may be provided between, e.g. longitudinally between, a/the at least one impeller of the mass flow excavation means and an/the outlet of the mass flow excavation means and/or the outlet of the jet flow excavation means.

Guide vanes may be provided within the housing to guide the mass flow, in use.

A/the nozzle may be removably connectable to the excavation apparatus. This may allow for replacement of the nozzle, e.g. if damaged, or exchange with another nozzle of different size and/or shape. In this way characteristics, e.g. pressure and/or flow rate, of the jet flow excavation means may be controlled and/or preselected, e.g. dependent upon the material and/or area to be excavated.

The excavation apparatus may comprise means for tilting or pivoting the at least one mass flow excavation means and/or the at least one jet flow excavation means, preferably together.

The tilting or pivoting means may allow the at least one mass flow excavation means and/or the at least one jet flow excavation means to tilt or pivot around an axis, e.g. a substantially horizontal axis.

In use, the excavation apparatus may be tethered to a vessel by a line(s), e.g. tugger lines, e.g. to maintain and/or adjust position of the excavation apparatus.

In a first implementation the housing may comprise a hollow body or hollow tubular housing, e.g. having an upper facing inlet and a lower facing outlet.

In said first implementation in one embodiment there may be provided within the housing at least a single impeller.

Alternatively in said first implementation in another embodiment there may be provided at least one pair of impellers coaxially displaced one from the other, and preferably rotatable in contra-rotating directions.

The impellers(s) may be rotatably mounted in the hollow body.

In said first implementation the excavation apparatus may comprise first and second excavation units.

Each unit may comprise a mass flow (excavation) means and a jet flow (excavation) means.

The units may be transversely disposed or spaced from one another, e.g. upon a frame or structure, e.g. side-by-side.

The frame or structure may comprise slide means which may act as a means for tilting or pivoting the/each unit, e.g. relative to the frame or structure.

The first implementation has been found to be particularly advantageous in relatively shallow depths of water, e.g. around 1 to 2 meters.

In a second implementation the housing may comprise a hollow body having at least two inlets and at least one outlet, at least one pair of impellers rotatably mounted in the hollow body, wherein the at least two inlets are substantially symmetrically disposed around an axis extending from the at least one outlet.

The housing may be "T" or "Y"-shaped.

In use, the impellers may be driven in contra-rotating directions. One of the impellers may be provided within one of the inlets and another of the impellers may be provided within another of the inlets.

In either or any implementation there may be provided means for driving the mass flow excavation means. The mass flow excavation drive means may comprise a hydraulic motor(s), or alternatively an electric motor(s).

There may be provided means for driving the jet flow excavation means. The jet flow excavation drive means may comprise a hydraulic motor(s), or alternatively an electric motor(s). The jet flow excavation drive means may comprise a centrifugal pump.

At least one of the at least one jet flow excavation means may be longitudinally aligned with at least one of the at least one mass flow excavation means.

According to a second aspect of the present invention there is provided an excavation apparatus, particularly an underwater excavation apparatus, comprising at least one impeller and at least one jet.

Preferably, in use, an outlet of the at least one jet is provided below the at least one impeller.

According to a third aspect of the present invention there is provided a combination of a mass flow excavation means and a jet flow excavation means.

Any of the features of any of the foregoing general solutions or aspects of the present invention may be provided either singly or in combination in any of the other general solutions or aspects, and are nor repeated or recited herein merely for reasons of brevity.

According to a fourth aspect of the present invention there is provided a method of excavating or excavation, particularly underwater excavating or excavation, comprising:

providing an underwater excavator apparatus according to the foregoing general solution or first or second aspects of the present invention or a combination accordingly to the third aspect of the present invention;

excavating a location or area, particularly an underwater location or area, using the underwater excavator or combination.

The underwater location or area may comprise or include a seabed, ocean floor, river bed, lake floor, a pipe, pipeline or a trench, or area(s) adjacent thereto or any combination thereof.

The excavator apparatus may bury or debury object(s) in the underwater location or area.

BRIEF DESCRIPTION OF DRAWINGS

Embodiments of the present invention will now be described by way of example only, and with reference to the accompanying drawings, which are:

FIG. 1(*b*) a top view of the underwater excavation apparatus of FIG. 1(*a*);

FIG. 1(*c*) a side view in partial cross-section of the underwater excavation apparatus of FIG. 1(*a*);

FIG. 1(*d*) a perspective view from below and to another side with some parts removed of the underwater excavation apparatus of FIG. 1(*a*);

FIG. 2(*b*) a top view of the underwater excavation apparatus of FIG. 2(*a*);

FIG. 2(*c*) an end view of the underwater excavation apparatus of FIG. 2(*a*);

FIG. 3(*b*) a top view of the underwater excavation apparatus of FIG. 3(*a*);

FIG. 3(*c*) a perspective view from below, to one side and to one end and with parts removed of the underwater excavation apparatus of FIG. 3(*a*); and FIG. 3(*d*) a perspective view from above, to one side and to one end of the underwater excavation apparatus of FIG. 3(*a*).

DETAILED DESCRIPTION OF DRAWINGS

Figure 1A:
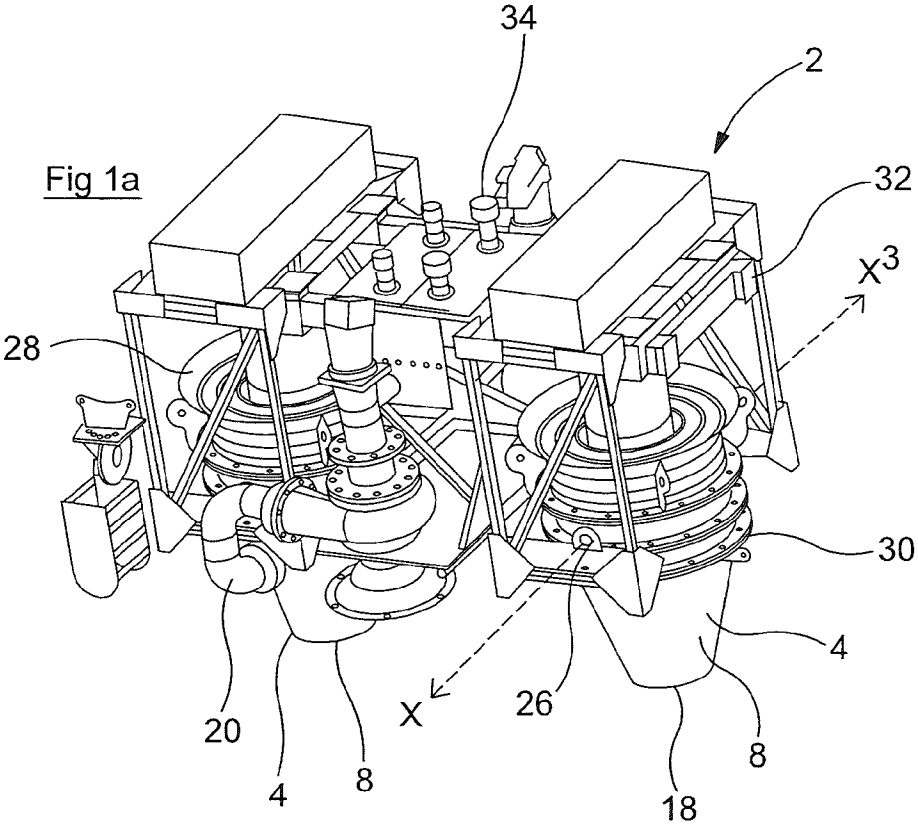
FIG. 1(*a*) a perspective view from above, to one side and to one end of an underwater excavation apparatus according to a first embodiment of the present invention.
Figure 1B:
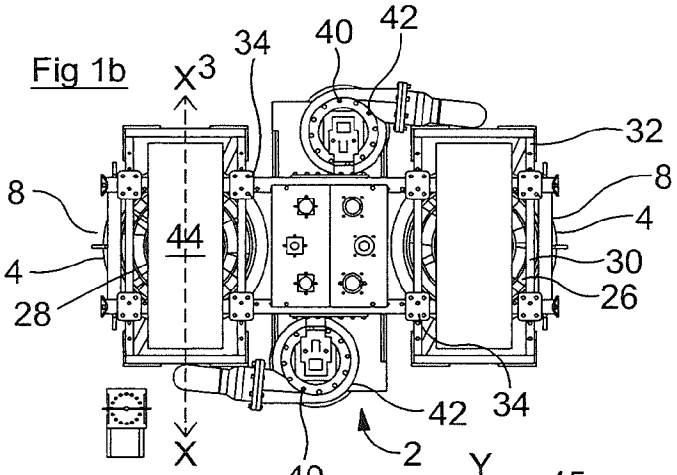
Figure 1C:
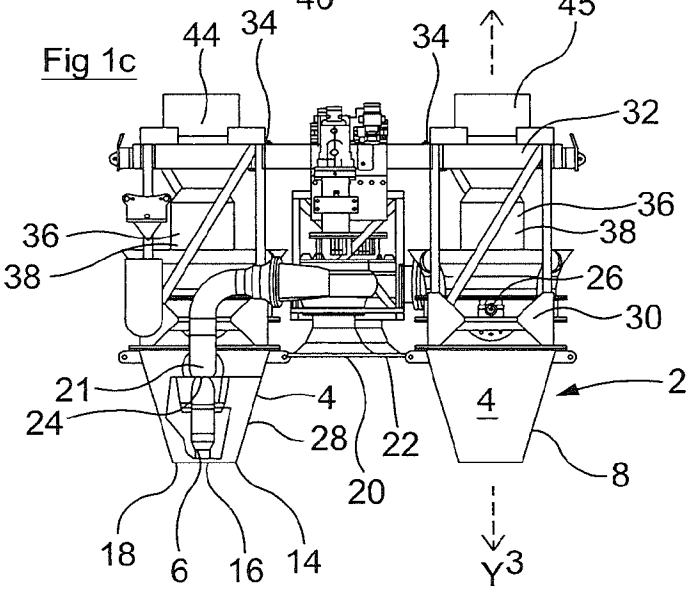
Figure 1D:
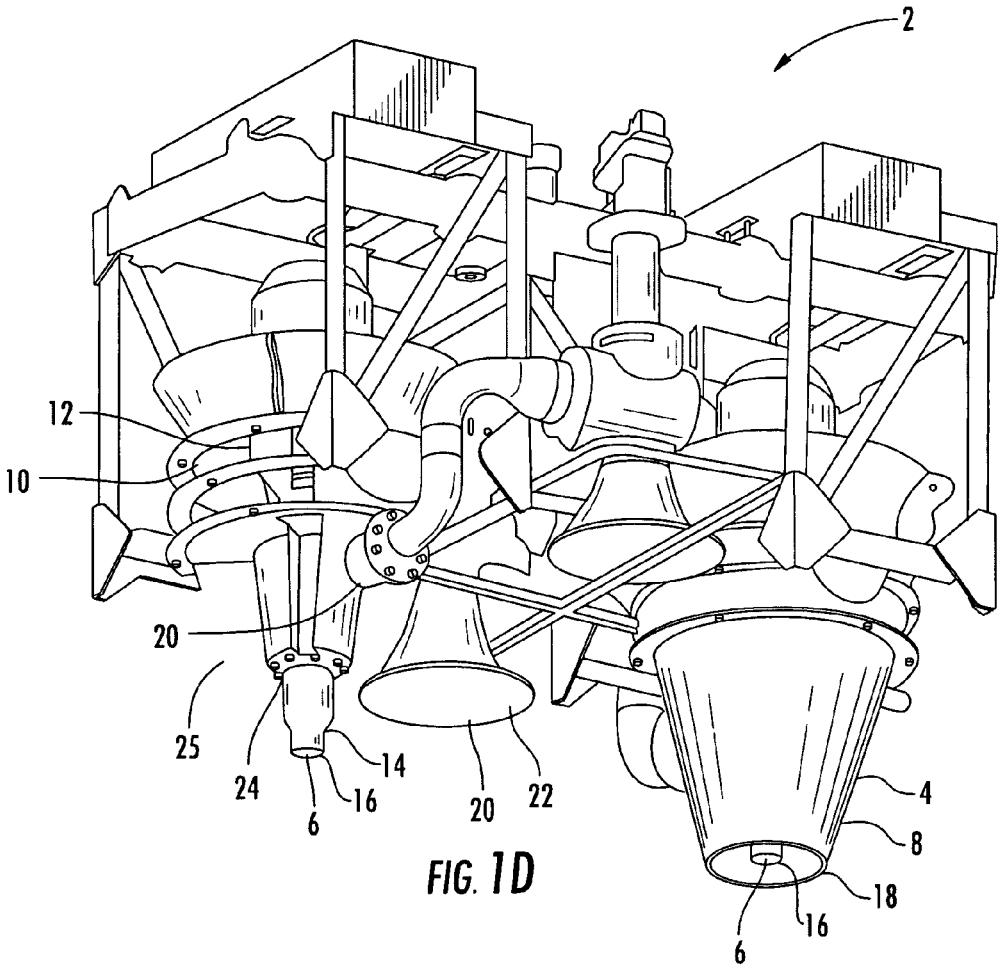

Referring initially to FIGS. 1(*a*) to (*d*), there is illustrated an excavation apparatus comprising an underwater excavation apparatus, generally designated 2, according to a first embodiment of the present invention.

The underwater excavation apparatus 2 comprises at least one mass flow excavation means 4 and at least one jet or jet flow excavation means 6. The at least one mass flow excavation means 4 comprises a housing 8 and at least one impeller 10 or rotor provided within the housing 8, which impeller 10 comprises a plurality of blades 12. The at least one jet flow excavation means 4 comprises at least one nozzle 14.

In use, the at least one mass flow excavation means 4 typically operates at or causes a mass flow of fluid/water at a pressure of around 10 to 50 KPa (KiloPascals). In use, the at lease one mass flow excavation means 4 operates at or causes the mass flow at a volume rate of around 0.5 to 8.0 $m^3/s$, and typically around 0.5 to 2.5 $m^3/s$.

In use, the at least one jet flow excavation means 6 operates at or causes a jet flow of fluid/water at a pressure of around 100 to 500 KPa (KiloPascals). In use, the at least one jet flow excavation means 6 operates at or causes jet flow at a volume rate of around 0.1 to 0.25 $m^3/s$.

An outlet 16 of the at least one jet flow excavation means 6 is provided within an outlet 18 of the at least one mass flow excavation means 4.

A breadth or diameter of the outlet 16 of the at least one jet flow excavation means 6 is typically around 12 to 15 cm. A breadth or diameter of the outlet 18 of the at least one mass flow excavation means 4 is typically around 75 to 125 cm, e.g. 100 cm.

In this embodiment, advantageously, the outlet 16 of the at least one jet flow excavation means 6 is substantially longitudinally aligned with, or coincident with, the outlet 18 of the at least one mass flow excavation means 4.

Further, in use, the mass flow is substantially longitudinally aligned with or parallel to the respective jet flow.

The outlet 18 of the at least one mass flow excavation means 4 comprises a closed shape, and in this embodiment is circular. In alternative embodiments, however, the outlet 18 of the at least one mass flow excavation means 4 can be elliptical, oblong, oval, square, rectangular or the like.

The outlet 16 of the at least one jet flow excavation means 6 comprises a closed shape, and in this embodiment, is circular. In alternative embodiments, however, the outlet 16 of the at least one jet flow excavation means 6 can be elliptical, oblong, square, oval, rectangular or the like.

An inlet 20 of the at least one jet flow excavation means 6 tapers or flares outwardly, e.g. in a trumpet-like shape. The inlet 20 of the at least one jet flow excavation means 6 is disposed to face in substantially the same direction the outlet 18 of the mass flow excavation means 4 and/or the outlet 16 of the jet flow excavation means 6.

The outlet 18 of the at least one mass flow excavation means 4 is disposed so as to face substantially downwardly, in use. The outlet 16 of the at least one jet flow excavation means 6 is disposed so as to face substantially downwardly, in use.

In this embodiment the inlet 20 of the at least one jet flow excavation means 6 is disposed so as to face substantially downwardly, in use. This arrangement has been found to be particularly beneficial. The inlet 20 of the at least one jet flow excavation means 6 is provided with a filter means 22.

The outlet 18 of the at least one mass flow excavation means 4 is inverted frusto-conical in shape. The nozzle 14 of the at least one jet flow excavation means 6 is substantially cylindrical and/or elongate in shape. The outlet 18 of the at least one mass flow excavation means 6 is substantially concentric with, or centralised with the nozzle 14 of the at least one jet flow excavation means 6. The outlet 16 of the at least one jet flow excavation means 6 is therefore contained within an area of the outlet 18 of the at least one mass flow excavation means 4.

An inlet means 24 to the nozzle 14 is provided between the at least one impeller 10 of the mass flow excavation means 4 and the outlet 18 of the mass flow excavation means 4 and/or the outlet 16 of the jet flow excavation means 6. Nozzle 14 is connected to inlet 20 via pipework 21.

Guide vanes 25 are provided within the housing 8 to guide the mass flow, in use. The guide vanes 25 are provided between the impeller 10 and the outlet 18.

The nozzle 14 is removably connectable to the excavation apparatus 2 at connection means 24. This allows for replacement of the nozzle 14, e.g. if damaged, or exchanged with another nozzle (not shown) of different size and/or shape. In this way characteristics, e.g. pressure and/or flow rate, of the jet flow excavation means 6 can be controlled and/or preselected, e.g. dependent upon the material to be excavated.

The excavation apparatus 2 comprise means 26 for tilting or pivoting the at least one mass flow excavation means 4 and/or the at least one jet flow excavation means 6. The tilting means 26 allows the at least one mass flow excavation means 4 and/or the at least one jet flow excavation means 6 to tilt or pivot an axis Y-Y' around an axis, e.g. a substantially transverse axis X-X'.

In use, the excavation apparatus 2 can be tethered to a vessel (not shown) by a line(s) (not shown) e.g. tugger lines, e.g. to maintain and/or adjust position of the excavation apparatus 2.

In a first implementation, as illustrated, the housing 8 comprises a hollow body or hollow tubular housing, e.g. having an upper facing inlet 26 and lower facing outlet 18. In said first implementation, as illustrated, there is provided within the housing 8 a single impeller 10. Alternatively in said first implementation, there can be provided at least one pair of impellers coaxially displaced one from the other and rotatable in contra-rotating directions. The impeller(s) 10 is/are rotatably mounted in the housing 8 for rotation around axis Y-Y'.

In this embodiment the excavation apparatus 2 comprises first and second excavation units 28, 30. Each unit 28, 30 comprises a mass flow excavation means 4 and a jet flow excavation means 6.

The units 28, 30 are transversely disposed or spaced from one another upon a frame or structure 32. The frame or structure 32 comprises releasably lockable slide means 34 which with the means for tilting 26 for the/each unit 28, 30, e.g. up to an angle of between 0° and 45° from the vertical, in use. In use, the excavation apparatus 2 is typically disposed such that the units 28,30 are located either side of an area, e.g. pipeline, to be excavated.

There is provided means 36 for driving the mass flow excavation means 4. The mass flow excavation driving means 36 comprise a hydraulic motor(s) 38. In an alternative implementation an electric motor(s) can be used.

There is provided means 40 for driving the jet flow excavation means 6. The jet flow excavation driving means 40 comprises a further hydraulic motor(s) 42. In an alternative implementation an electric motor(s) can be used.

In use, the outlet 16 of the at least one jet excavation means 6 is provided below the at least one impeller 10.

The frame 32 provides a plurality of hydraulic feeds 34—six (6) in this case—two (2) high pressure lines; two (2) low pressure lines; and two (2) case drain lines, one each for each of the hydraulic motor 38 and further hydraulic motor 42. The frame 32 also carries first and second ballast 44,45.

In use, one provides the underwater evacuator 2 and excavates a location or area particularly an underwater location or area, using the underwater excavation 2.

The underwater area typically comprises a pipe or pipeline or a trench (not shown). The excavation can bury or debury object(s) in the location or area.

Figure 2B:
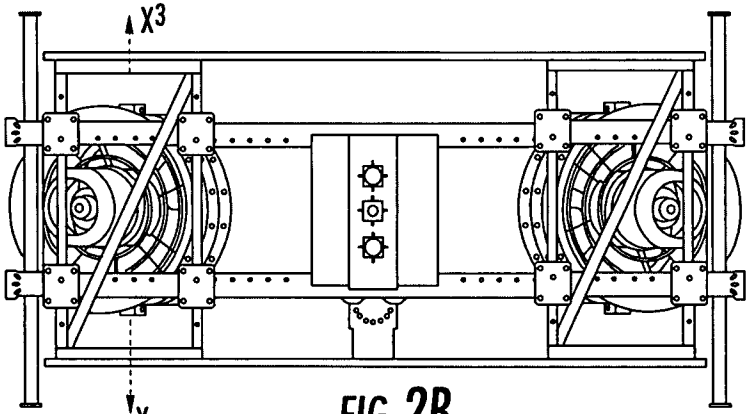
FIG. 2(*a*) a side view of an underwater excavation apparatus according to a second embodiment of the present invention in a particular (tilted) disposition.
Figure 2C:
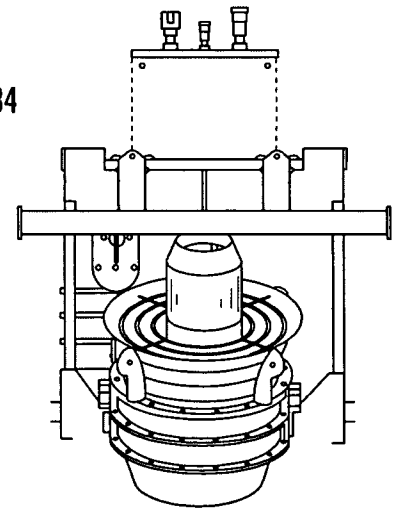
Figure 2A:
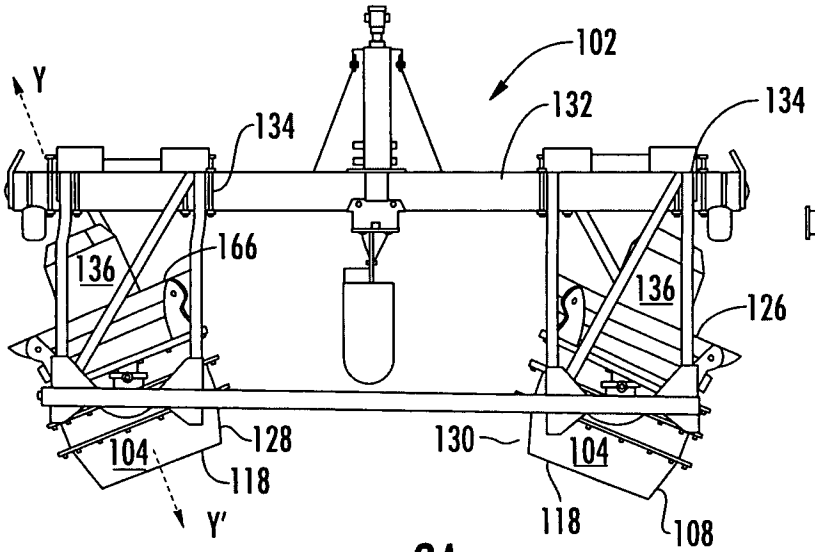
Figure 3C:
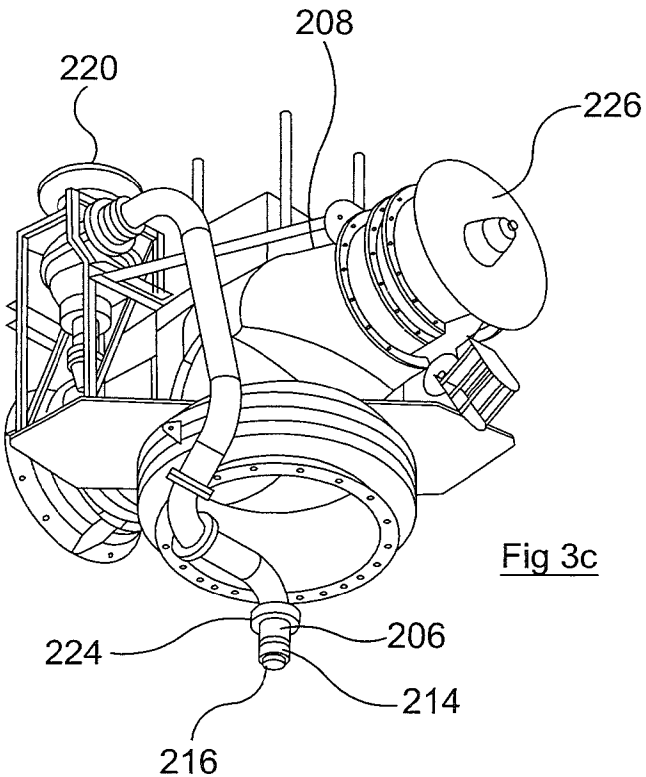
FIG. 3(*a*) a side view of an underwater excavation apparatus according to a third embodiment of the present invention.
Figure 3A:
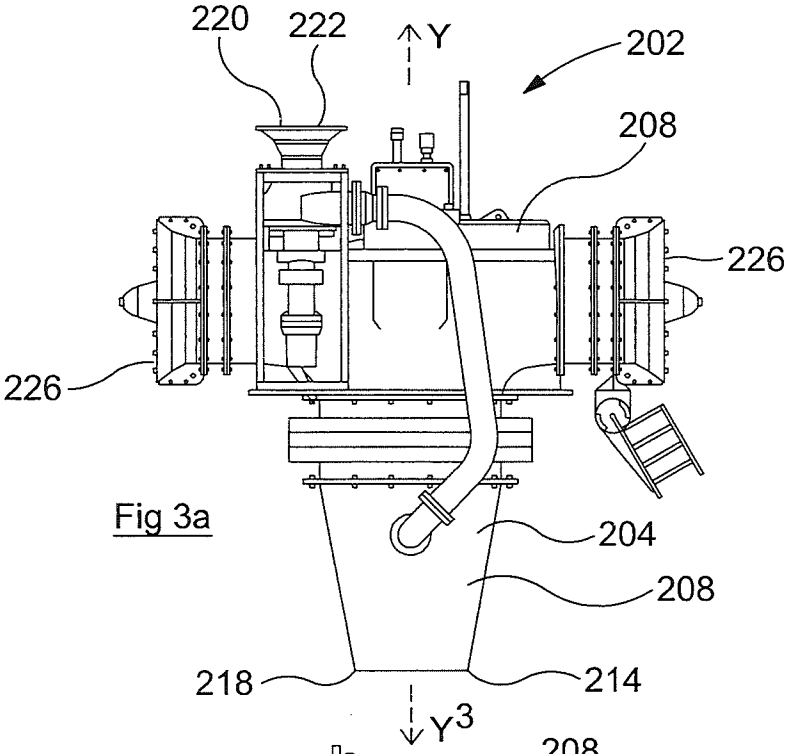
Figure 3B:
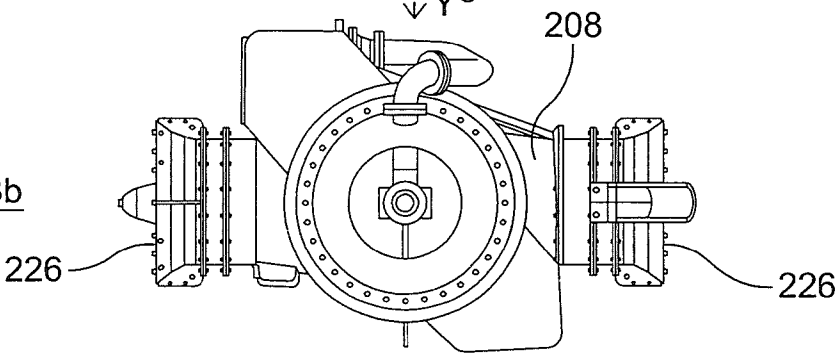
Figure 3D:
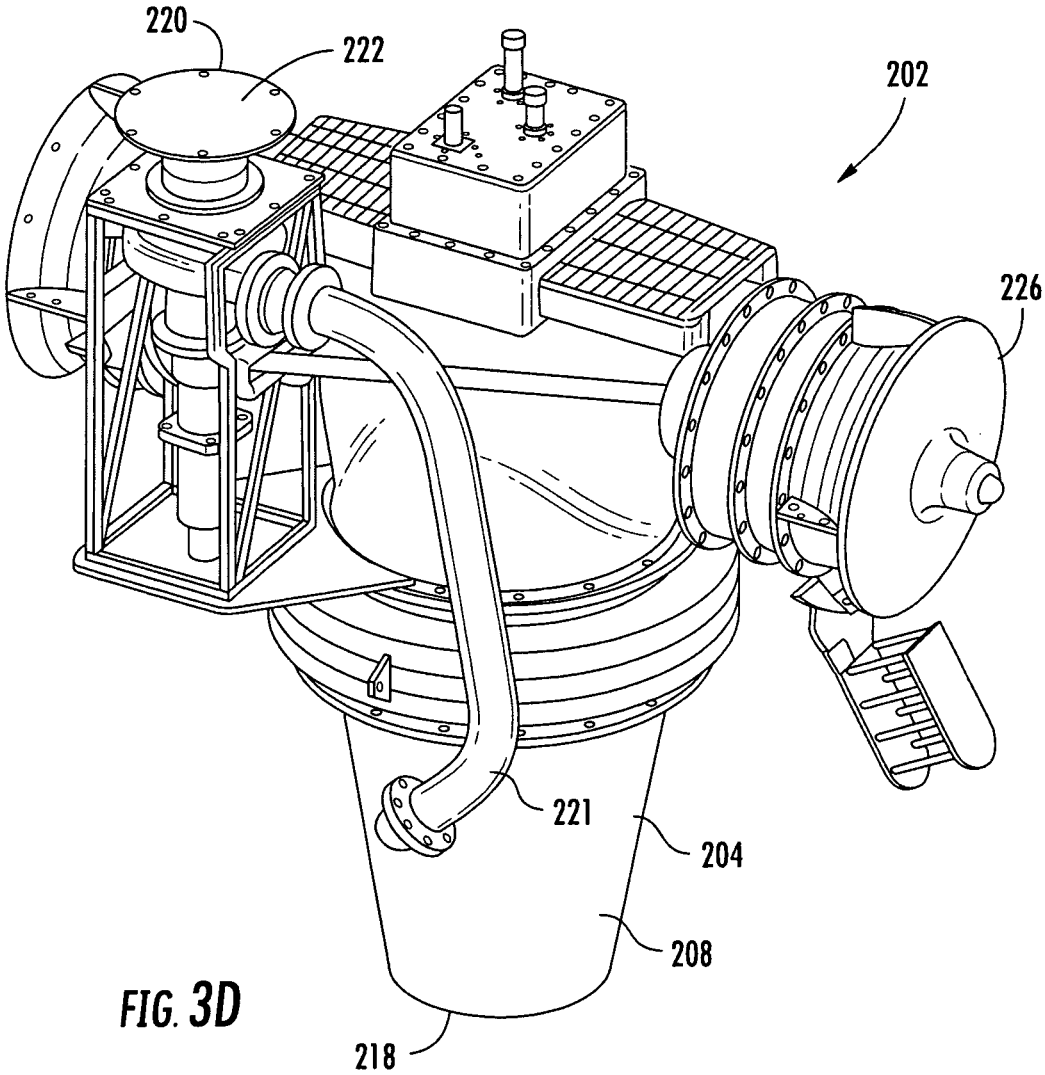

Referring now to FIGS. 2(*a*) to (*c*), there is illustrated an underwater excavation apparatus, generally designated 102, according to a second embodiment of the present invention. Like parts of the apparatus 102 are designated by the same numerals as for the apparatus 2 of the first embodiment, but incremented by "100".

In this second embodiment the units 128, 130 are shown in a tilted disposition. Tiltable longitudinal axes Y-Y' of the units 128, 130 meet (when tilted) at a point below the apparatus 102, which point is typically below a pipeline (not shown), in use.

Referring now to FIGS. 3(*a*) to (*d*), there is illustrated an underwater excavation apparatus, generally designated 202, according to a third embodiment of the present invention. Like parts of the apparatus 202 are designated by the same numerals as for the apparatus 2 of the first embodiment, but incremented by "200".

In this third embodiment the housing 208 comprises a hollow body having two outlets 226 and at least one outlet 218, and at least one part of impellers rotatably mounted in the hollow body, wherein the at least two inlets 226 are substantially symmetrically disposed around an axis Y-Y' extending from the at least one outlet 218.

In use, the impellers are driven in contra-rotating directions. One of the impellers is provided within one of the inlets 226 and another of the impellers is provided within another of the inlets 226.

It will be appreciated that the embodiments of the invention hereinbefore described are given by way of example only, and are not meant to be limiting of the scope of the invention in any way.

The invention claimed is:

1. An underwater excavation apparatus, comprising at least one mass flow excavation means and at least one jet flow excavation means, wherein an outlet of the at least one jet flow excavation means is provided within an outlet of the at least one mass flow excavation means, and wherein an outlet of the at least one jet flow excavation means is substantially longitudinally aligned with the outlet of the at least one mass flow excavation means.

2. The underwater excavation apparatus as claimed in claim 1, wherein the mass flow excavation means moves material with relatively low pressure (Kilopascals, KPa) and the jet flow excavation means cuts through or disrupts material with relatively high pressure (KPa).

3. The underwater excavation apparatus as claimed in claim 1, wherein the at least one mass flow excavation means comprises a housing and at least one impeller or rotor provided within the housing, which impeller comprises a plurality of blades.

4. The underwater excavation apparatus as claimed claim 1, wherein the at least one jet flow excavation means face substantially downwardly in use, and comprises at least one nozzle.

5. The underwater excavation apparatus as claimed in claim 1, wherein, in use, the at least one mass flow excavation means operates at or causes a mass flow at a pressure less than a pressure of a jet flow operated at or caused by the at least one respective jet flow excavation means.

6. The underwater excavation apparatus as claimed in claim 1, wherein, in use, the at least one mass flow excavation means operates at or causes a mass flow at a volume rate greater than a jet flow volume rate per unit area operated at or caused by the at least one respective jet flow excavation means.

7. The underwater excavation apparatus as claimed in claim 1, wherein, in use, the at least one mass flow excavation means operates at or causes a mass flow at a pressure of around 10 to 50 KPa.

8. The underwater excavation apparatus as claimed in claim 1, wherein, in use, the at least one mass flow excavation means operates at or causes a mass flow at a volume rate of around 0.5 to 8.0 $m^3/s$, or around 0.5 to 2.5 $m^3/s$.

9. The underwater excavation apparatus as claimed in claim 1, wherein, in use, the at least one jet flow excavation means operates at or causes a jet flow at a pressure of around 100 to 500 KPa.

10. The underwater excavation apparatus as claimed in claim 1, wherein, in use, the at least one jet flow excavation means operates at or causes a jet flow at a volume rate of around 0.1 to 0.25 $m^3/s$.

11. The underwater excavation apparatus as claimed in claim 1, wherein a breadth or diameter of an outlet of the at least one jet flow excavation means and an outlet of a nozzle is around 12 to 15 cm.

12. The underwater excavation apparatus as claimed in claim 1, wherein a breadth or diameter of an outlet of the at least one mass flow excavation means is selected from one of around 75 cm to 125 cm.

13. The underwater excavation apparatus as claimed in claim 1, wherein, in use, at least one mass flow from at least one of the at least one mass flow excavation means is substantially parallel to at least one jet flow from at least one of the at least one jet flow excavation means.

14. The underwater excavation apparatus as claimed in claim 1, wherein an outlet of the at least one mass flow excavation means comprises a closed shape optionally selected from one of circular, elliptical, oval, oblong square and rectangular.

15. The underwater excavation apparatus as claimed in claim 1, wherein an outlet of the at least one jet flow excavation means comprises a closed shape selected from the group consisting of circular, elliptical, oblong, oval, square, and rectangular.

16. The underwater excavation apparatus as claimed in claim 1, wherein an inlet of the at least one jet flow excavation means tapers or flares outwardly.

17. The underwater excavation apparatus as claimed in claim 1, wherein an inlet of the at least one jet flow excavation means is disposed to face in substantially a same direction as an outlet of the mass flow excavation means and an outlet of the jet flow excavation means.

18. The underwater excavation apparatus as claimed in claim 1, wherein an outlet of the at least one mass flow excavation means is disposed so as to face substantially downwardly, in use.

19. The underwater excavation apparatus as claimed in claim 1, wherein an outlet of the at least one jet flow excavation means is disposed so as to face substantially downwardly, in use.

20. The underwater excavation apparatus as claimed in claim 1, wherein an inlet of the at least one jet flow excavation means is disposed in a different direction to a respective inlet or inlets of the mass flow means, and the inlet of the at least one jet flow excavation means is disposed so as to face at least partially or substantially downwardly, in use.

21. The underwater excavation apparatus as claimed in claim 1, wherein an inlet of the at least one jet flow excavation means is provided with a filter means.

22. The underwater excavation apparatus as claimed in claim 1, wherein an outlet of the at least one mass flow excavation means is inverted frusto-conical in shape.

23. The underwater excavation apparatus as claimed in claim 1, wherein a nozzle of the at least one jet flow excavation means is substantially cylindrical or elongate in shape.

24. The underwater excavation apparatus as claimed in claim 1, wherein an outlet of the at least one mass flow excavation means surrounds or is substantially concentric with or centralised with or contains an outlet of or nozzle of the at least one jet flow excavation means.

25. The underwater excavation apparatus as claimed in claim 24, wherein an inlet means to the nozzle is provided between an at least one impeller of the mass flow excavation means and an outlet of the mass flow excavation means and the outlet of the jet flow excavation means.

26. The underwater excavation apparatus as claimed in claim 3, wherein guide vanes are provided within the housing to guide the mass flow, in use.

27. The underwater excavation apparatus as claimed in claim 1, wherein a nozzle is removably connectable to the excavation apparatus.

28. The underwater excavation apparatus as claimed in claim 1, wherein the excavation apparatus comprises means for tilting or pivoting the at least one mass flow excavation means and the at least one jet flow excavation means.

29. The underwater excavation apparatus as claimed in claim 28, wherein the tilting or pivoting means allows the at least one mass flow excavation means and the at least one jet flow excavation means to tilt or pivot around an axis.

30. The underwater excavation apparatus as claimed in claim 1, wherein, in use, the excavation apparatus is tethered to a vessel by a line.

31. The underwater excavation apparatus as claimed in claim 3, wherein the housing comprises a hollow body or hollow tubular housing, having an upper facing inlet and a lower facing outlet.

32. The underwater excavation apparatus as claimed in claim 31, wherein there is provided within the housing at least a single impeller.

33. The underwater excavation apparatus as claimed in claim 31, wherein at least one pair of impellers are coaxially displaced one from the other.

34. The underwater excavation apparatus as claimed in claim 32, wherein the impellers are rotatably mounted in the hollow body.

35. The underwater excavation apparatus as claimed in claim 31, wherein the excavation apparatus comprises first and second excavation units.

36. The underwater excavation apparatus as claimed in claim 35, wherein each unit comprises a mass flow means and a jet flow means.

37. The underwater excavation apparatus as claimed in claim 36, wherein the units are transversely disposed or spaced from one another.

38. The underwater excavation apparatus as claimed in claim 37, wherein the units are transversely disposed or spaced from one another upon a frame or structure, optionally side-by-side, and the frame or structure comprises slide means which acts as a means for tilting or pivoting the/each unit.

39. The underwater excavation apparatus as claimed in claim 3, wherein the housing comprises a hollow body having at least two inlets and at least one outlet, at least one pair of impellers rotatably mounted in the hollow body, wherein the at least two inlets are substantially symmetrically disposed around an axis extending from the at least one outlet.

40. The underwater excavation apparatus as claimed in claim 39, wherein the housing is selected from one of "T" and "Y"-shaped.

41. The underwater excavation apparatus as claimed in claim 39, wherein, in use, the impellers are driven in contra-rotating directions, one of the impellers being provided within one of the inlets and another of the impellers being provided within another of the inlets.

42. The underwater excavation apparatus as claimed in claim 1, wherein there is provided means for driving the mass flow excavation means.

43. The underwater excavation apparatus as claimed in claim 42, wherein the mass flow excavation drive means is selected from a hydraulic motor or motors and an electric motor or motors.

44. The underwater excavation apparatus as claimed in claim 1, wherein there are provided means for driving the jet flow excavation means.

45. The underwater excavation apparatus as claimed in claim 44, wherein the jet flow excavation drive means is selected from a hydraulic motor, or an electric motor or motors, and a centrifugal pump.

46. The underwater excavation apparatus as claimed in claim 1, wherein at least one of the at least one jet flow excavation means is longitudinally aligned with at least one of the at least one mass flow excavation means.

47. A method of underwater excavating or excavation of an underwater location or area, comprising:

providing an underwater excavator apparatus according to claim 1.

48. The method of underwater excavating or excavation as claimed in claim 47, wherein the underwater location or area comprises a pipe, pipeline or a trench, or area adjacent thereto, or a sea bed, ocean floor, river bed or lake floor.

49. The underwater excavation apparatus as claimed in claim 1, wherein the mass flow excavation means moves material with relatively low pressure (Kilopascals, KPa) or the jet flow excavation means cuts through or disrupts material with relatively high pressure (KPa).

50. The underwater excavation apparatus as claimed claim 1, wherein the at least one jet flow excavation means face substantially downwardly in use, or comprises at least one nozzle.

51. The underwater excavation apparatus as claimed in claim 1, wherein a breadth or diameter of an outlet of the at least one jet flow excavation means or an outlet of a nozzle is around 12 to 15 cm.

52. The underwater excavation apparatus as claimed in claim 1, wherein an inlet of the at least one jet flow excavation means is disposed to face in substantially a same direction as an outlet of the mass flow excavation means or an outlet of the jet flow excavation means.

53. The underwater excavation apparatus as claimed in claim 1, wherein an inlet of the at least one jet flow excavation means is disposed in a different direction to a respective inlet or inlets of the mass flow means, or the inlet of the at least one jet flow excavation means is disposed so as to face at least partially or substantially downwardly, in use.

54. The underwater excavation apparatus as claimed in claim 1, wherein the excavation apparatus comprises means for tilting or pivoting the at least one mass flow excavation means or the at least one jet flow excavation means.

55. The underwater excavation apparatus as claimed in claim 28, wherein the tilting or pivoting means allows the at least one mass flow excavation means or the at least one jet flow excavation means to tilt or pivot around an axis.

56. The underwater excavation apparatus as claimed in claim 44, wherein the jet flow excavation drive means and the mass flow excavation means are fixed to or positioned within a frame or structure.

57. An underwater excavation apparatus, comprising at least one mass flow excavation means and at least one jet flow excavation means, wherein an outlet of the at least one jet flow excavation means is provided within an outlet of the at least one mass flow excavation means, and wherein, in use, at least one mass flow from at least one of the at least one mass flow excavation means is substantially parallel to at least one jet flow from at least one of the at least one jet flow excavation means.

58. An underwater excavation apparatus as claimed in claim 57, wherein the mass flow excavation means moves material with relatively low pressure (Kilopascals, KPa) and the jet flow excavation means cuts through or disrupts material with relatively high pressure (KPa).

59. The underwater excavation apparatus as claimed in claim 57, wherein the at least one mass flow excavation means comprises a housing and at least one impeller or rotor provided within the housing.

60. The underwater excavation apparatus as claimed in claim 57, wherein, in use, the at least one mass flow excavation means operates at or causes a mass flow at a pressure less than a pressure of a jet flow operated at or caused by the at least one respective jet flow excavation means.

61. The underwater excavation apparatus as claimed in claim 57, wherein, in use, the at least one mass flow excavation means operates at or causes a mass flow at a volume rate greater than a jet flow volume rate per unit area operated at or caused by the at least one respective jet flow excavation means.

62. The underwater excavation apparatus as claimed in claim 57, wherein an outlet of the at least one mass flow excavation means is substantially concentric with or centralised with an outlet of or nozzle of the at least one jet flow excavation means.

63. An underwater excavation apparatus, comprising at least one mass flow excavation means and at least one jet flow excavation means, wherein an outlet of the at least one jet flow excavation means is provided within an outlet of the at least one mass flow excavation means, wherein the outlet of the at least one mass flow excavation means is substantially concentric with the outlet of the at least one jet flow excavation means, and wherein an inlet means to the outlet of the at least one jet flow excavation means is provided between an at least one impeller of the mass flow excavation means and the outlet of the mass flow excavation means and the outlet of the jet flow excavation means.

64. An underwater excavation apparatus as claimed in claim 63, wherein the mass flow excavation means moves material with relatively low pressure (Kilopascals, KPa) and the jet flow excavation means cuts through or disrupts material with relatively high pressure (KPa).

65. The underwater excavation apparatus as claimed in claim 63, wherein the at least one mass flow excavation means comprises a housing and at least one impeller or rotor provided within the housing.

66. The underwater excavation apparatus as claimed in claim 63, wherein, in use, the at least one mass flow excavation means operates at or causes a mass flow at a pressure less than a pressure of a jet flow operated at or caused by the at least one respective jet flow excavation means.

67. The underwater excavation apparatus as claimed in claim 63, wherein, in use, the at least one mass flow excavation means operates at or causes a mass flow at a volume rate greater than a jet flow volume rate per unit area operated at or caused by the at least one respective jet flow excavation means.

68. An underwater excavation apparatus, comprising at least one mass flow excavation means and at least one jet flow excavation means, wherein the at least one mass flow excavation means comprises a housing and at least one impeller provided within the housing, wherein guide vanes are provided within the housing to guide the mass flow, in use, and wherein an outlet of the at least one jet flow excavation means is provided within an outlet of the at least one mass flow excavation means.

69. An underwater excavation apparatus as claimed in claim 68, wherein the mass flow excavation means moves material with relatively low pressure (Kilopascals, KPa) and the jet flow excavation means cuts through or disrupts material with relatively high pressure (KPa).

70. An underwater excavation apparatus as claimed in claim 68, wherein, in use, the at least one mass flow excavation means operates at or causes a mass flow at a pressure less than a pressure of a jet flow operated at or caused by the at least one respective jet flow excavation means.

71. An underwater excavation apparatus as claimed in claim 68, wherein, in use, the at least one mass flow excavation means operates at or causes a mass flow at a volume rate greater than a jet flow volume rate per unit area operated at or caused by the at least one respective jet flow excavation means.

72. An underwater excavation apparatus, comprising at least one mass flow excavation means and at least one jet flow excavation means, wherein the at least one mass flow excavation means comprises a housing and at least one impeller provided within the housing, wherein the housing comprises a hollow body, having an upper facing inlet and a lower facing outlet and wherein an outlet of the at least one jet flow excavation means is provided within an outlet of the at least one mass flow excavation means.

73. The underwater excavation apparatus as claimed in claim 72, wherein there is provided within the housing at least a single impeller.

74. An underwater excavation apparatus as claimed in claim 72, wherein at least one pair of impellers are coaxially displaced one from the other.

75. An underwater excavation apparatus as claimed in claim 74, wherein the impellers are rotatably mounted in the hollow body.

76. An underwater excavation apparatus as claimed in claim 72, wherein the excavation apparatus comprises first and second excavation units.

77. An underwater excavation apparatus as claimed in claim 76, wherein each unit comprises a mass flow means and a jet flow means.

78. An underwater excavation apparatus as claimed in claim 77, wherein the units are transversely disposed or spaced from one another.

79. An underwater excavation apparatus as claimed in claim 78, wherein the units are transversely disposed or spaced from one another upon a frame or structure, optionally side-by-side, and the frame or structure comprises slide means which acts as a means for tilting or pivoting the/each unit.

80. An underwater excavation apparatus, comprising at least one mass flow excavation means and at least one jet flow excavation means, wherein the at least one mass flow excavation means comprises a housing and at least one pair of impellers provided within the housing, wherein the housing comprises a hollow body having at least two inlets and at least one outlet, wherein the at least one pair of impellers are rotatably mounted in the hollow body, wherein the at least two inlets are substantially symmetrically disposed around an axis extending from the at least one outlet, and wherein an outlet of the at least one jet flow excavation means is provided within an outlet of the at least one mass flow excavation means.

81. The underwater excavation apparatus as claimed in claim 80, wherein the housing is selected from one of "T" and "Y"-shaped.

82. The underwater excavation apparatus as claimed in claim 80, wherein, in use, the impellers are driven in contra-rotating directions, one of the impellers being provided within one of the inlets and another of the impellers being provided within another of the inlets.

83. The underwater excavation apparatus as claimed in claim 80, wherein the at least one pair of impellers are coaxially displaced one from the other.

* * * * *